US007760164B2

(12) United States Patent
Shin

(10) Patent No.: US 7,760,164 B2
(45) Date of Patent: Jul. 20, 2010

(54) ORGANIC LIGHT EMITTING DIODE DISPLAY DEVICE AND DRIVING METHOD THEREOF

(75) Inventor: Dong-Yong Shin, Yongin-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 952 days.

(21) Appl. No.: 11/506,492

(22) Filed: Aug. 18, 2006

(65) Prior Publication Data

US 2007/0046593 A1 Mar. 1, 2007

(30) Foreign Application Priority Data

Aug. 26, 2005 (KR) ..... 10-2005-0078729

(51) Int. Cl.
*G09G 3/30* (2006.01)

(52) U.S. Cl. ..... 345/76; 35/77

(58) Field of Classification Search ..... 345/76–83; 315/169.3

See application file for complete search history.

(56) References Cited

U.S. PATENT DOCUMENTS

| | | | | |
|---|---|---|---|---|
| 6,441,560 | B1 * | 8/2002 | Hunter | 315/169.1 |
| 6,720,942 | B2 * | 4/2004 | Lee et al. | 345/82 |
| 6,812,651 | B2 * | 11/2004 | Iwata et al. | 315/169.3 |
| 7,202,606 | B2 * | 4/2007 | Eom et al. | 315/169.3 |
| 7,277,071 | B2 * | 10/2007 | Oh | 345/76 |
| 7,317,434 | B2 * | 1/2008 | Lan et al. | 345/76 |
| 7,358,938 | B2 * | 4/2008 | Kim | 345/77 |
| 7,460,093 | B2 * | 12/2008 | Ozawa et al. | 345/76 |
| 2004/0032382 | A1 * | 2/2004 | Cok et al. | 345/82 |
| 2004/0145547 | A1 * | 7/2004 | Oh | 345/76 |
| 2004/0196239 | A1 * | 10/2004 | Kwon | 345/92 |
| 2004/0263440 | A1 * | 12/2004 | Kimura et al. | 345/76 |
| 2006/0253755 | A1 * | 11/2006 | Wu | 714/726 |

OTHER PUBLICATIONS

D. Fish, et al., "35.2: Improved Optical Feedback for AMOLED Display Differential Ageing Compensation," SID 04 Digest, pp. 1120-1123, ISSN/0004-0966X/04/3502-1120, 2004.

D. A. Fish, et al., "Improved optical feedback for OLED differential ageing correction," Journal of the SID 13/2, pp. 131-138, 2005.

* cited by examiner

*Primary Examiner*—Alexander Eisen
*Assistant Examiner*—Nelson Lam
(74) *Attorney, Agent, or Firm*—Christie, Parker & Hale, LLP

(57) ABSTRACT

An organic light emitting diode display device. A first capacitor is coupled between a gate of a first transistor and a first voltage source, and a second transistor is coupled between the gate of the first transistor and a second voltage source. A third transistor is coupled between the first voltage source and the gate of the first transistor, and a fourth transistor is coupled to a data line. A second capacitor stores the data voltage from the fourth transistor, and is for determining a gate-source voltage of the first transistor. The threshold voltage compensator compensates a threshold voltage of the third transistor together with the second capacitor, and the fifth transistor transmits a current of a drain of the first transistor to the organic light emitting diode. A photoelectric transformation element transmits a current corresponding to a light emitted by the organic light emitting diode to the second capacitor.

17 Claims, 8 Drawing Sheets

ORGANIC LIGHT EMITTING DIODE DISPLAY DEVICE AND DRIVING METHOD THEREOF

CROSS-REFERENCES TO RELATED APPLICATION

This application claims priority to and the benefit of Korean Patent Application No. 10-2005-0078729, filed in the Korean Intellectual Property Office on Aug. 26, 2005, the entire content of which is incorporated herein by reference.

BACKGROUND OF THE INVENTION

1. Field of the Invention

The present invention relates to an organic light emitting diode display device and a driving method thereof.

2. Description of the Related Art

An organic light emitting diode display device is a display device for electrically exciting phosphorous organic compounds to emit light. The organic light emitting diode display device drives organic light emitting cells to represent images. The organic light emitting cell has characteristics of a diode and so is called an organic light emitting diode. The organic light emitting cell includes an anode, an organic thin film, and a cathode.

Generally, the brightness of the organic light emitting diode is degraded as time passes. Optical feedback, which is a technique that measures the light emitted by the organic light emitting diode in a pixel and feeds back the measurement to correct for the degradation of the organic light emitting diode, has been introduced in order to compensate the degradation of the organic light emitting diode.

For example, in a pixel circuit using optical feedback, a voltage is stored by a storage capacitor coupled between a gate and a source of a driving transistor, and a turn-on time of a control transistor coupled to the storage capacitor is controlled to represent a gray level. In more detail, data corresponding to a gray level is stored by a control capacitor coupled between a gate and a source of the control transistor, and a voltage of the control capacitor is controlled according to a light emitted from the OLED to control the turn-on time of the control transistor.

However, the turn-on time of different control transistors for the same gray level may not be uniform because of variation of threshold voltages of the control transistors, the variation being caused by non-uniformity of a manufacturing process. As such, the organic light emitting diode display device has difficulties in obtaining uniform gray level due to brightness deviations between the pixels.

SUMMARY OF THE INVENTION

An aspect of the present invention provides an organic light emitting diode display device having an optical feedback pixel circuit for compensating a variation of a threshold voltage of a transistor.

One exemplary embodiment of the present invention provides an organic light emitting diode display device including first to fifth transistors, first and second capacitors, a threshold voltage compensator, an organic light emitting diode, and a photoelectric transformation element. A first electrode of the first transistor is coupled to a first voltage source, and the first capacitor is coupled between a control electrode of the first transistor and the first voltage source. The second transistor coupled between the control electrode of the first transistor and a second voltage source is turned on in response to an on voltage of a first control signal. The third transistor has a first electrode coupled to the first voltage source and a second electrode coupled to the control electrode of the first transistor. The fourth transistor having a first electrode coupled to a data line for transmitting a data voltage transmits the data voltage in response to an on voltage of a second control signal. The second capacitor stores the data voltage from the fourth transistor, and is for determining a voltage between the first electrode of the first transistor and the control electrode of the first transistor. The threshold voltage compensator compensates a threshold voltage of the third transistor together with the second capacitor, and the fifth transistor transmits a current of a second electrode of the first transistor to the organic light emitting diode in response to an on voltage of a third control signal. The photoelectric transformation element transmits a current corresponding to a light emitted by the organic light emitting diode to the second capacitor.

The third control signal may have an off voltage for a first period in which the threshold voltage compensator compensates the threshold voltage, and for a second period in which the first control signal and the second control signal respectively have on voltages.

A first electrode of the second capacitor may be coupled to the first voltage source, and the threshold voltage compensator may include sixth and seventh transistors and a third capacitor. The sixth transistor electrically couples a control electrode of the third transistor to a second electrode of the third transistor in response to an on voltage of a fourth control signal. The third capacitor has a first electrode coupled to the control electrode of the third transistor and a second electrode coupled to a second electrode of the second capacitor. The seventh transistor couples the first electrode of the third capacitor to the first voltage source in response to the on voltage of the fourth control signal.

The photoelectric transformation element may be coupled between the second voltage source and the second electrode of the third capacitor.

Another exemplary embodiment of the present invention provides an organic light emitting diode display device including first to third transistors, a first capacitor, a threshold voltage compensator, an organic light emitting diode, and a photoelectric transformation element. A first electrode of the first transistor is coupled to a first voltage source, and the second transistor having a first electrode coupled to a data line for transmitting a data voltage transmits the data voltage in response to an on voltage of a first control signal. The first capacitor stores the data voltage from the second transistor, and is for determining a voltage between the first electrode of the first transistor and a control electrode of the first transistor. The threshold voltage compensator compensates a threshold voltage of the first transistor together with the first capacitor, and the third transistor transmits a current of a second electrode of the first transistor to the organic light emitting diode in response to an on voltage of a second control signal. The photoelectric transformation element is coupled between the control electrode of the first transistor and the first voltage source, and generates a current corresponding to a light emitted by the organic light emitting diode to the second capacitor.

The second control signal may have an off voltage for a first period in which the threshold voltage compensator compensates the threshold voltage and for a second period in which the first control signal has an on voltage.

The first electrode of the first capacitor may be coupled to the first voltage source, and the threshold voltage compensator may include fourth and fifth transistors and a second capacitor. The fourth transistor electrically couples the control electrode of the first transistor to a second electrode of the first transistor in response to an on voltage of a third control signal. The second capacitor has a first electrode coupled to the control electrode of the first transistor and a second electrode coupled to a second electrode of the first capacitor. The fifth transistor couples the first electrode of the second capacitor to the first voltage source in response to the on voltage of the third control signal.

Still another exemplary embodiment of the present invention provides a driving method of an organic light emitting diode display device which includes an organic light emitting diode and a photoelectric transformation element for generating a current corresponding to a light emitted by the organic light emitting diode. The driving method provides a first transistor having a first electrode coupled to a first voltage source for supplying a first voltage, a second transistor having a first electrode coupled to the first voltage source, a first capacitor having a first electrode coupled to the first voltage source, a second capacitor having a first electrode coupled to a control electrode of the first transistor, and a third capacitor coupled to the first electrode of the second transistor and a control electrode of the second transistor. The control electrode of the first transistor is coupled to a second electrode of the first transistor, and a second electrode of the second capacitor is coupled to the first voltage source. A second voltage is stored by the third capacitor. The second electrode of the second capacitor is coupled to a second electrode of the first capacitor, and a data voltage is applied to the second electrode of the first capacitor and the second electrode of the second capacitor. A current of a second electrode of the second transistor is transmitted to the organic light emitting diode, and the current of the photoelectric transformation element is transmitted to the first electrode of the second capacitor.

DETAILED DESCRIPTION

Figure 1:
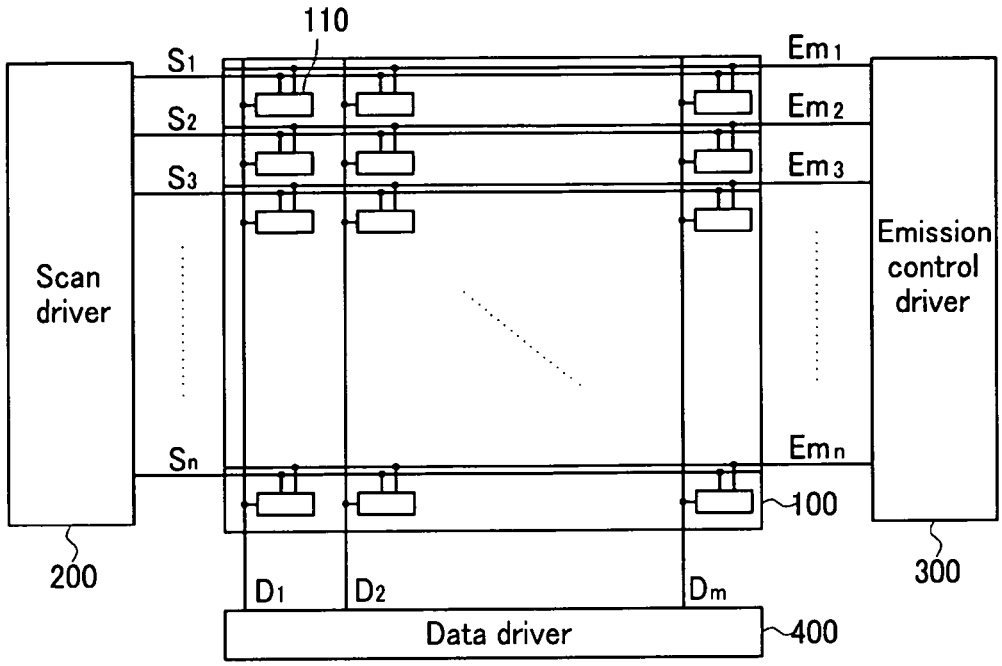
FIG. 1 shows a plan view of an organic light emitting diode display device according to one exemplary embodiment of the present invention.

In the following detailed description, only certain exemplary embodiments of the present invention are shown and described, simply by way of illustration. As those skilled in the art would realize, the described embodiments may be modified in various different ways, all without departing from the spirit or scope of the present invention.

Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements. Here, when a first element is described as being coupled to a second element, the first element may be directly coupled to the second element, or may be indirectly coupled to the second element via a third element.

FIG. 1 shows a plan view of an organic light emitting diode display device according to one exemplary embodiment of the present invention.

As shown in FIG. 1, the organic light emitting diode display device includes a display area 100, a scan driver 200, an emission control driver 300, and a data driver 400.

The display area 100 includes a plurality of data lines $D_1$ to $D_m$, a plurality of scan lines $S_1$ to $S_n$, a plurality of emission control lines $Em_1$ to $Em_n$, and a plurality of pixels 110. The plurality of data lines $D_1$ to $D_m$, the plurality of scan lines $S_1$ to $S_n$, the plurality of emission control lines $Em_1$ to $Em_n$, and the plurality of pixels 110 are formed on a substrate (not shown).

The data lines $D_1$ to $D_m$ are extended in a column direction and transmit data voltages representing gray levels to corresponding pixels 110. The scan lines $S_1$ to $S_n$ are extended in a row direction and transmit select signals for selecting corresponding lines of the scan lines $S_1$ to $S_n$ to apply the data voltages to the pixels 110 of the corresponding lines. The emission control lines $Em_1$ to $Em_n$ are extending in a row direction and transmit emission control signals for controlling light emission of the pixels 110. A pixel area is defined by one of the data lines $D_1$ to $D_m$ and one of the scan lines $S_1$ to $S_n$, and the pixel 110 is formed on the pixel area.

In addition, for color display, each pixel uniquely emits one of the primary colors (i.e., spatial division), or sequentially emits the primary colors in turn (i.e., temporal division) such that a spatial or temporal sum of the primary colors forms a desired color. An example of a set of the primary colors includes red, green, and blue. In the temporal division, one pixel sequentially emits red, green, and blue colors, and accordingly forms the desired color. In the spatial division, the desired color is formed by three pixels such as red, green, and blue pixels. Each of the red, green, and blue pixels may be referred to as a sub-pixel, and the three sub-pixels (i.e., the red, green, and blue sub-pixels) may be referred to as one pixel.

The data driver 400 sequentially receives the data signals representing gray levels from a timing controller (not shown), converts the received data signals to the data voltages, and applies the converted data voltages corresponding to the pixels of the scan lines $S_1$ to $S_n$ to which select signals are applied to the data lines $D_1$ to $D_m$. The scan driver 200 and the emission control drivers 300 synthesize an on voltage and an off voltage to generate the scan signals and the emission control signals, and apply the select signals and the emission control signals to the scan lines $S_1$ to $S_n$ and the emission control lines $Em_1$ to $Em_n$, respectively. Here, when a select signal or an emission control signal has an on voltage, a transistor that has a gate coupled to a line receiving (or corresponding to) the select signal or the emission control signal is turned on.

In one embodiment, the scan driver 200, the emission control driver 300, and/or the data driver 400 are fabricated as integrated circuits (ICs), and the ICs are mounted on a substrate on which the display area 100 is formed. Alternatively, in one embodiment, the ICs are mounted on flexible connecting members, such as tape carrier packages (TCPs) and flexible printed circuits (FPCs), and the flexible connecting members are attached to the substrate to be coupled thereto. On the other hand, the scan driver 200 and/or the data driver 400 may be substituted with driving circuits formed in the substrate, which are made of the same layers as the scan lines, the data lines, and the transistors for driving the sub-pixels. In addition, the scan driver 200 and/or the data driver 400 may be mounted on printed circuit boards which are electrically coupled to the substrate on which the display area 100 is formed.

A pixel circuit 111 formed on a pixel 110 of an organic light emitting diode display device according to a first exemplary embodiment of the present invention will be described with reference to FIG. 2 and FIG. 3.

Figure 2:
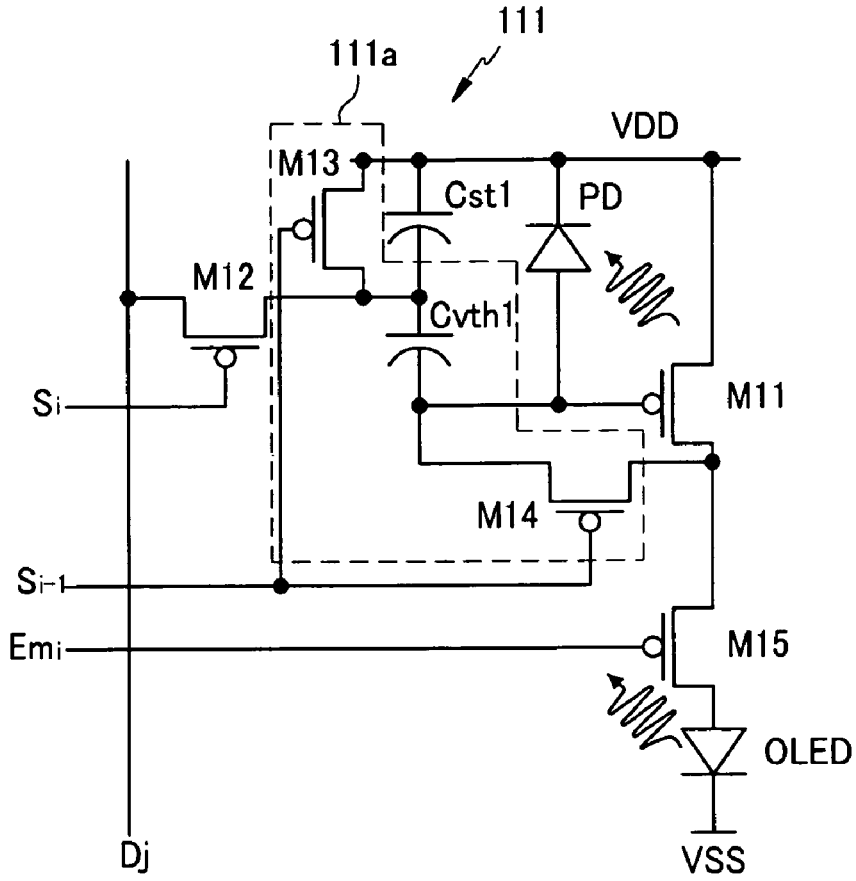
FIG. 2 shows a circuit diagram of a pixel circuit according to a first exemplary embodiment of the present invention.
Figure 3:
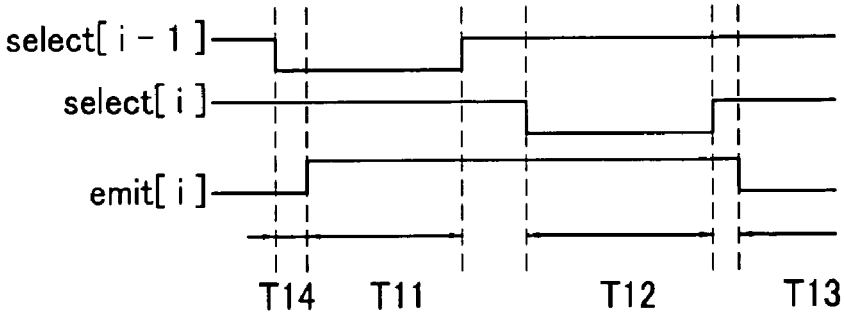
FIG. 3 shows a signal timing diagram of the pixel circuit shown in FIG. 2.

FIG. 2 shows a circuit diagram of the pixel circuit 111 according to the first exemplary embodiment of the present invention, and FIG. 3 shows a signal timing diagram of the pixel circuit 111 shown in FIG. 2. For ease of description, FIG. 2 shows a pixel circuit coupled to a j-th data line $D_j$ and an i-th scan line $S_i$ (where 'j' is an integer between 1 and 'm', and 'i' is an integer between 1 and 'n').

On the other hand, as to terminology of the scan lines and the select signals, the scan line for driving a transistor coupled to the data line to transmit the data voltage is referred to as a "current scan line", and the select signal that is transmitted to the current scan line is referred to as a "current select signal". In addition, the scan line that has transmitted the select signal before the current select signal is referred to as a "previous scan line", and the select signal that has transmitted to the previous scan line is referred to as a "previous select signal".

As shown in FIG. 2, the pixel circuit 111 includes a driving transistor M11, a switching transistor M12, a capacitor $C_{st1}$, a threshold voltage compensator 111*a*, an emission control transistor M15, an organic light emitting diode OLED, and a photoelectric transformation element PD, and the threshold voltage compensator 111*a* includes transistors M13 and M14 l and a capacitor $C_{vth1}$. In FIG. 2, the transistors M11 to M15 are depicted as p-channel field effect transistors, and, more particularly, PMOS (p-channel metal oxide semiconductor) transistors. These transistors M11 to M15 have a source and a drain corresponding to a first electrode and a second electrode, respectively, and a gate corresponding to a third or control electrode.

The driving transistor M11 has a source coupled to a voltage source VDD, and the emission control transistor M15 is coupled between a drain of the driving transistor M11 and an anode of the organic light emitting diode OLED. The organic light emitting diode OLED has a cathode coupled to a voltage source VSS, which supplies a voltage that is lower than a voltage $V_{DD}$ supplied from the voltage source VDD, and the organic light emitting diode OLED emits light corresponding to an applied current. The emission control transistor M15 has a gate coupled to the emission control line $Em_i$, and transmits a current from the driving transistor M11 to the organic light emitting diode OLED in response to a low-level emission control signal of the emission control line $Em_i$.

The switching transistor M12 has a gate coupled to the current scan line $S_i$ and a source coupled to the data line $D_j$, and transmits the data voltage from the data line $D_j$ in response to a low-level select signal of the current scan line $S_i$. A first electrode of the capacitor $C_{st1}$ is coupled to the voltage source VDD, and a second electrode of the capacitor $C_{st1}$ is coupled to a drain of the switching transistor M12. The capacitor $C_{vth1}$ has a first electrode coupled to the gate of the driving transistor M11 and a second electrode coupled to the second electrode of the capacitor $C_{st1}$. The transistor M13 is coupled between the voltage source VDD and the second electrode of the capacitor $C_{st1}$, and has a gate coupled to the previous scan line $S_{i-1}$. The transistor M14 having a gate coupled to the previous scan line $S_{i-1}$ is coupled between the gate and the drain of the driving transistor M13, and diode-connects the driving transistor M11 (or electrically couples or connects the gate of the driving transistor M11 to the drain of the driving transistor M13) in response to a low-level select signal of the previous scan line $S_{i-1}$.

The photoelectric transformation element PD is coupled between the voltage source VDD and the gate of the driving transistor M13, and outputs an electric signal (a current) corresponding to a light emitted by the organic light emitting diode OLED. For example, a photodiode or a photo transistor may be used as the photoelectric transformation element PD in the pixel circuit 111. In FIG. 2, the photoelectric transformation element PD is depicted as a photodiode having a cathode coupled to the voltage source VDD and an anode coupled to the gate of the driving transistor, and the photodiode PD generates a reverse bias current corresponding to the light emitted by the organic light emitting diode OLED. The photoelectric transformation element PD may be formed at a position that is opposite to the organic light emitting diode OLED in order to properly detect the light emitted by the organic light emitting diode OLED.

An operation of the pixel circuit 111 shown in FIG. 2 will be described with reference to FIG. 3. In FIG. 3, the previous select signal of the previous scan line $S_{i-1}$ is depicted as select[i−1], the current select signal of the current scan line $S_i$ is depicted as select[i], and the emission control signal of the emission control line $Em_i$ is depicted as emit[i]. In addition, on voltages of the select and emission control signals select [i−1], select[i], and emit[i] are depicted as low-level in FIG. 3 since the transistors M13-M17 have been depicted as the p-channel transistors in FIG. 2

Referring to FIG. 3, for a period T11, the previous select signal select[i−1] is low-level, and the emission control signal emit[i] is high-level. Then, the transistor M14 is turned on such that the driving transistor M11 is diode-connected. In addition, the transistor M13 is turned on such that the second electrode of the capacitor $C_{vth1}$ is coupled to the voltage source VDD through the transistor M13, and the transistor M15 is turned off such that the driving transistor M11 is electrically blocked (or isolated) from the organic light emitting diode OLED. Accordingly, the threshold voltage $V_{TH1}$ of the driving transistor M11 is stored by the capacitor $C_{vth1}$ such that the first electrode voltage of the capacitor $C_{vth1}$, i.e., a gate voltage of the driving transistor M11, becomes a voltage of $V_{DD}+V_{TH1}$.

For a period T12, the previous select signal select is high-level, and the current select signal select is[i] low-level. Then, the transistors M13 and M14 are turned off and the transistor M12 is turned on such that the data voltage $V_{data}$ from the data line $D_i$ is applied to the second electrode of the capacitor $C_{st1}$ and the second electrode of the capacitor $C_{vth1}$. Due to the capacitor $C_{vth1}$, the gate voltage of the driving transistor M11 becomes a voltage of $V_{TH1}+V_{data}$, and a gate-source voltage $V_{GS1}$ of the driving transistor M11 becomes a voltage of $V_{TH1}+V_{data}-V_{DD}$. In addition, the voltage of $V_{TH1}+V_{data}-V_{DD}$ is stored by the capacitors $C_{st1}$ and $C_{vth1}$.

For a period T13, the current select signal select[i] is high-level, and the emission control signal emit[i] is low-level. Then, the transistor M15 is turned on such that a current $I_{OLED}$ of the driving transistor M11 flows through the organic light emitting diode OLED. As a result, the organic light emitting diode OLED emits light. The current $I_{OLED}$ of the driving transistor M11 is given as Equation 1 by the gate-source voltage $V_{GS1}$ of the driving transistor M11. Since the current $I_{OLED}$ expressed in Equation 1 is independent (i.e., determined regardless) of the threshold voltage $V_{TH1}$ of the driving transistor M11, the current $I_{OLED}$ is not affected by the variation of the threshold voltage.

$$\begin{aligned} I_{OLED} &= \frac{\beta}{2}(V_{GS1} - V_{TH1})^2 \\ &= \frac{\beta}{2}((V_{TH1} + V_{data} - V_{DD}) - V_{TH1})^2 \\ &= \frac{\beta}{2}(V_{DD} - V_{data})^2 \end{aligned} \quad \text{Equation 1}$$

where β is a constant determined by a channel width, a channel length, and electron mobility of the driving transistor M11, and $V_{DD}$ is a voltage supplied by the voltage source VDD.

In addition, a current corresponding to the light emitted by the organic light emitting diode OLED flows to the photoelectric transformation element PD in a reverse direction. The charges stored by the capacitors $C_{st}$ and $C_{vth1}$ are changed according to the current of the photoelectric transformation element PD. That is, a first electrode voltage (or a voltage of the first electrode) of the capacitor $C_{vth1}$ is increased by the current of the photoelectric transformation element PD to a high level, which is proportional to the brightness of the organic light emitting diode OLED, such that the current stop flowing through the driving transistor M11. Accordingly, in the case that the brightness of the organic light emitting diode OLED is not degraded, the driving transistor M11 is quickly turned off such that the brightness is decreased. In the case that the brightness of the organic light emitting diode OLED is degraded as time passes, the driving transistor M11 is slowly turned off such that the brightness is increased. As a result, the pixel circuit 111 shown in FIG. 2 can compensate the degradation of the brightness of the organic light emitting diode OLED.

In addition, as shown in FIG. 3, the emission control signal emit[i] may be low-level for an early stage T14 of a period in which the previous select signal select[i−1] is low-level. Then, the charges stored by the capacitor $C_{vth1}$ are discharged to the voltage source VSS such that a voltage of the capacitor $C_{vth1}$ is initialized.

Furthermore, while the emission control signal emit[i] has been described to be low-level in FIG. 3 after the current select signal select[i] becomes high-level, the emission control signal emit[i] may be low-level for a period in which the current select signal select[i] is low-level. However, in this case, the gate voltage of the driving transistor Ml1 may be changed to the voltage of $V_{TH1}+V_{data}$ since the organic light emitting diode OLED emits light when the data voltage $V_{data}$ is applied.

As described above, the pixel circuit 111 according to the first exemplary embodiment can compensate the variation of the threshold voltage of the driving transistor M11 and the degradation of the brightness of the organic light emitting diode OLED.

A pixel circuit 112 formed on a pixel 110 of an organic light emitting diode display device according to a second exemplary embodiment of the present invention will be described with reference to FIG. 4, FIG. 5, and FIGS. 6A to 6D.

Figure 4:
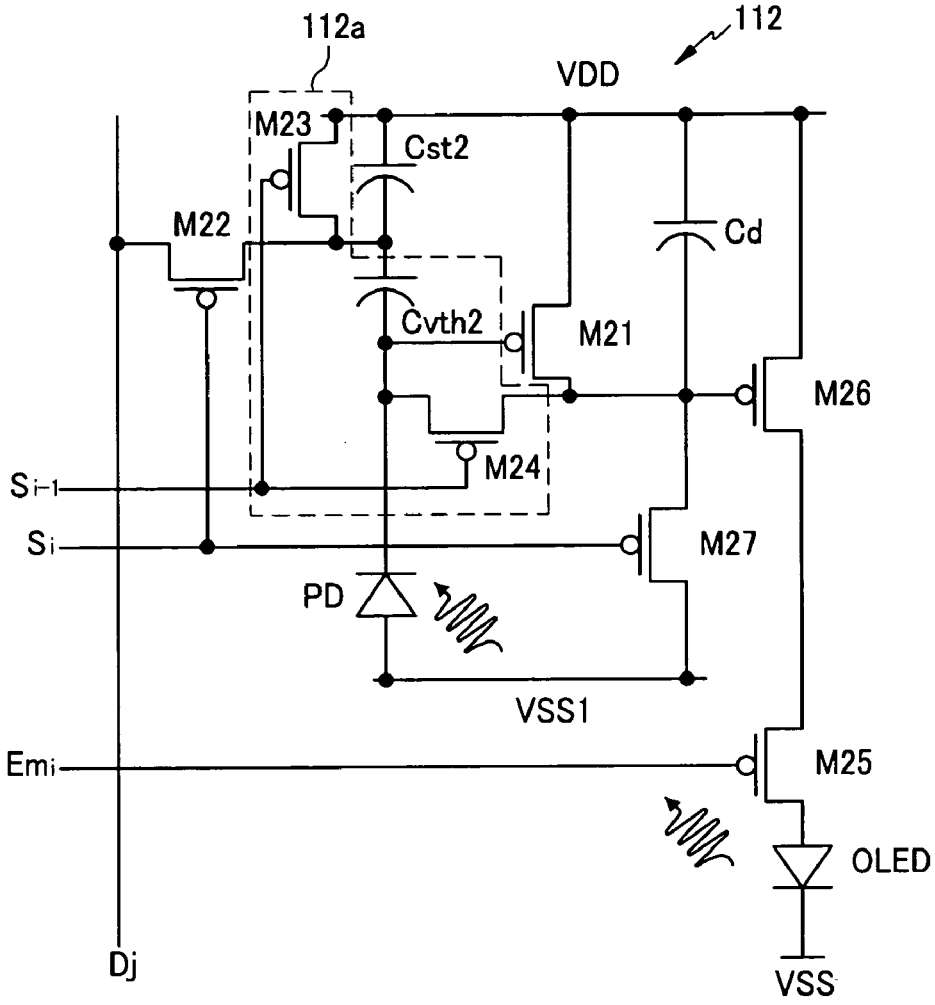
FIG. 4 shows a circuit diagram of a pixel circuit according to a second exemplary embodiment of the present invention.

FIG. 4 shows a circuit diagram of the pixel circuit 112 according to the second exemplary embodiment of the present invention.

As shown in FIG. 4, the pixel circuit 112 includes a driving transistor M26, switching transistors M22 and M27, a control transistor M21, capacitors $C_{st2}$ and $C_d$, a threshold voltage compensator 112*a*, an emission control transistor M25, an organic light emitting diode OLED, and a photoelectric transformation element PD; and the threshold voltage compensator 112*a* includes transistors M23 and M24 and a capacitor $C_{vth2}$.

Connections of the transistors M21 to M24 and the capacitors $C_{st2}$ and $C_{vth2}$ are substantially the same as those of the transistors M11 to M14 and the capacitors $C_{st1}$ and $C_{vth1}$ shown in FIG. 2, respectively. In addition and as shown in FIG. 4, the driving transistor M26 has a source coupled to a voltage source VDD, and the capacitor $C_d$ is coupled between a gate and the source of the driving transistor M26. The emission control transistor M25 having a gate coupled to the emission control line $Em_i$ is coupled between a drain of the driving transistor M26 and an anode of the organic light emitting diode OLED. A cathode of the organic light emitting diode OLED is coupled to a voltage source VSS that supplies a lower voltage than the voltage source VDD. The transistor M27 has a gate coupled to the current scan line $S_i$ and is coupled between the gate of the driving transistor M26 and a voltage source VSS1 which supplies a lower voltage than the voltage source VDD. The transistor M27 transmits a voltage $V_{SS1}$ from the voltage source VSS1 to the capacitor $C_d$ in response to a low-level select signal from the current scan line $S_i$.

The photoelectric transformation element PD is coupled between the voltage source VSS1 and a gate of the control transistor M21, and applies an electric signal (a current) corresponding to a light emitted by the organic light emitting diode OLED to the capacitors $C_{vth2}$ and $C_{st2}$. In FIG. 4, the photoelectric transformation element PD is depicted as a photodiode having an anode coupled to the voltage source VSS1 and a cathode coupled to the gate of the transistor M21.

Next, an operation of the pixel circuit 112 shown in FIG. 4 will be described with reference to FIG. 5 and FIGS. 6A to 6D.

Figure 5:
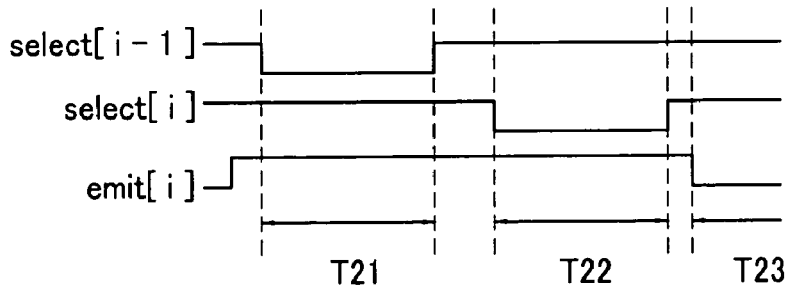
FIG. 5 shows a signal timing diagram of the pixel circuit shown in FIG. 4.

FIG. 5 shows a signal timing diagram of the pixel circuit 112 shown in FIG. 4 and FIGS. 6A to 6D shows time series operations of the pixel circuit 112, respectively.

Figure 6A:
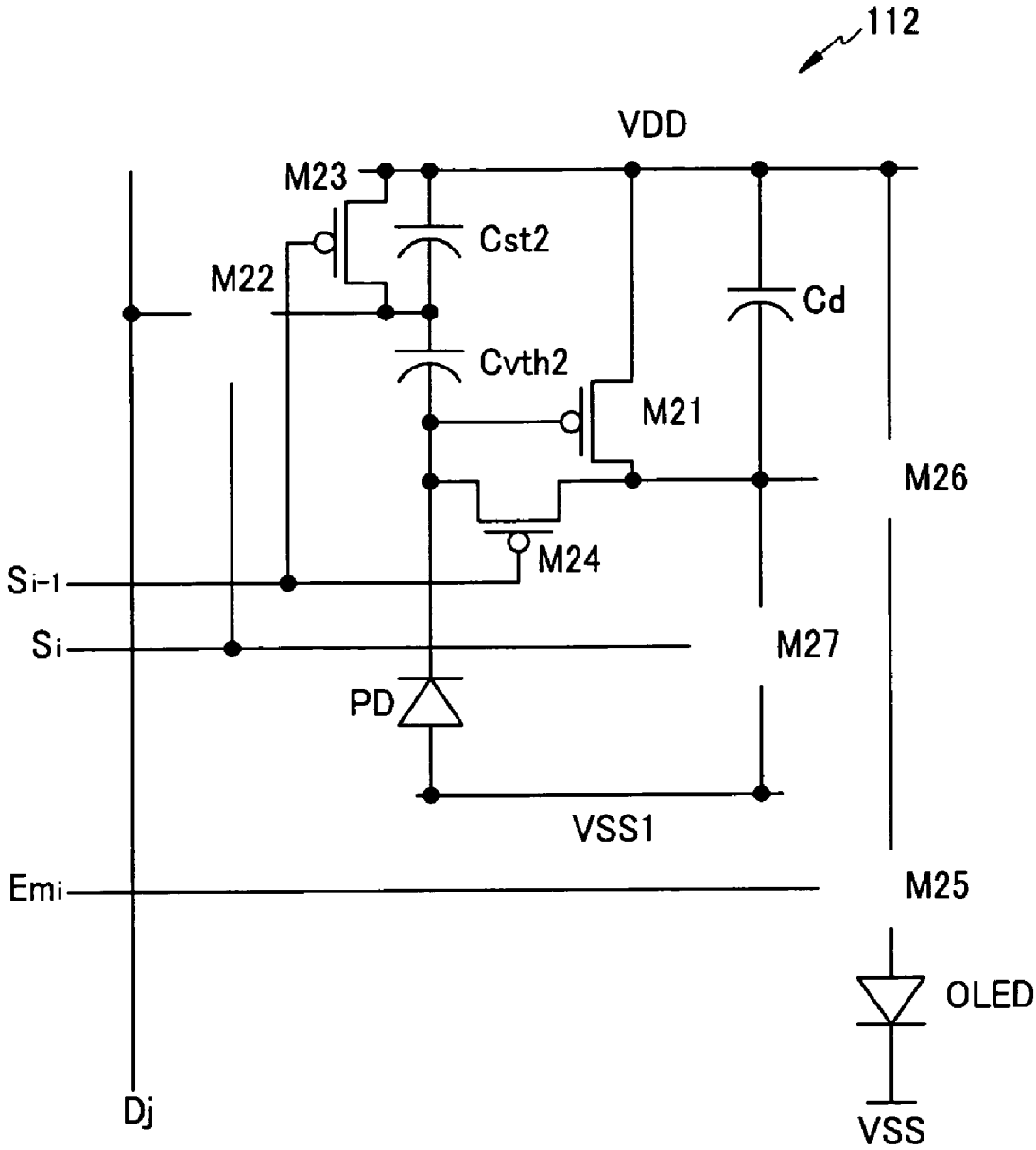
FIGS. 6A, 6B, 6C, and 6D show time series operations of the pixel circuit shown in FIG. 4, respectively.

For a period T21, the emission control signal emit[i] is high-level, and the previous select signal select[i−1] is low-level Then, as shown in FIG. 6A, the transistor M24 is turned on such that the control transistor M21 is diode-connected (or electrically couples or connects the gate of the control transistor M21 to the drain of the control transistor M21). In addition, the transistor M23 is turned on such that the second electrode of the capacitor $C_{vth2}$ is coupled to the voltage source VDD through the transistor M23. Since the transistor M27 is turned off by a high-level current select signal select [i], the control transistor M21 is electrically blocked from the voltage source VSS1. Accordingly, the threshold voltage $V_{TH2}$ of the control transistor M21 is stored by the capacitor $C_{vth2}$ such that the first electrode voltage of the capacitor $C_{vth2}$, i.e., a gate voltage of the driving transistor M21, becomes a voltage of $V_{DD}+V_{TH2}$.

Figure 6B:
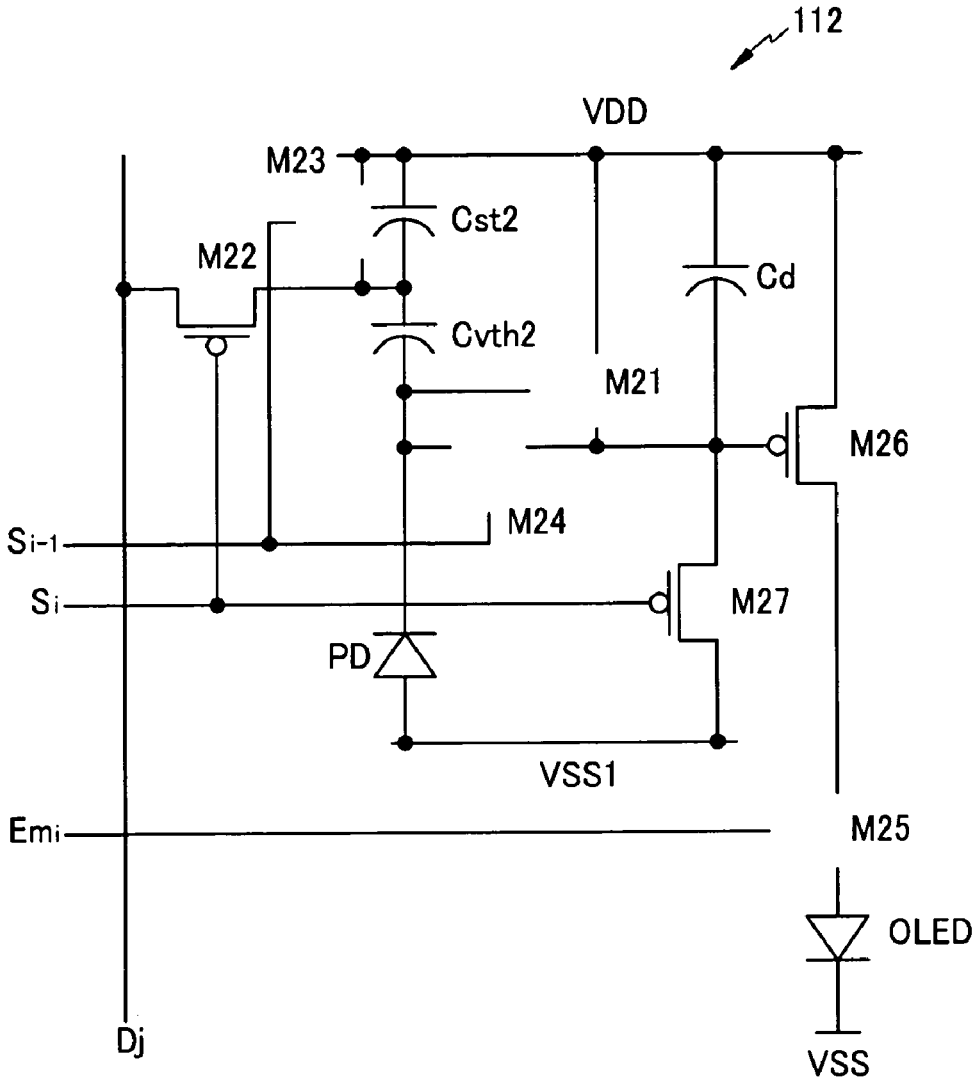

For a period T22, the previous select signal select[i−1] is high-level, and the current select signal select[i] is low-level. Then, as shown in FIG. 6B, the transistors M23 and M24 are turned off and the transistor M22 is turned on such that the data voltage $V_{data}$ from the data line $D_i$ is applied to the second electrodes of the capacitor $C_{st2}$ and $C_{vth2}$. As described in the period T12 of FIG. 3, a gate-source voltage $V_{GS2}$ of the control transistor M21 becomes a voltage of $V_{TH2}+V_{data}-V_{DD}$, and the voltage of $V_{TH1}+V_{data}-V_{DD}$ is stored to the capacitors $C_{st2}$ and $C_{vth2}$. Also, in order to maintain the transistor M26 in the turn-off state, the data voltage $V_{data}$ may have a voltage that is higher than the voltage $V_{DD}$ and corresponds to a gray level. In addition, the transistor M27 is turned on such that a voltage of $V_{DD}-V_{SS1}$ corresponding to a voltage difference between the voltage sources VDD and VSS1 is stored by the capacitor $C_d$.

Figure 6C:
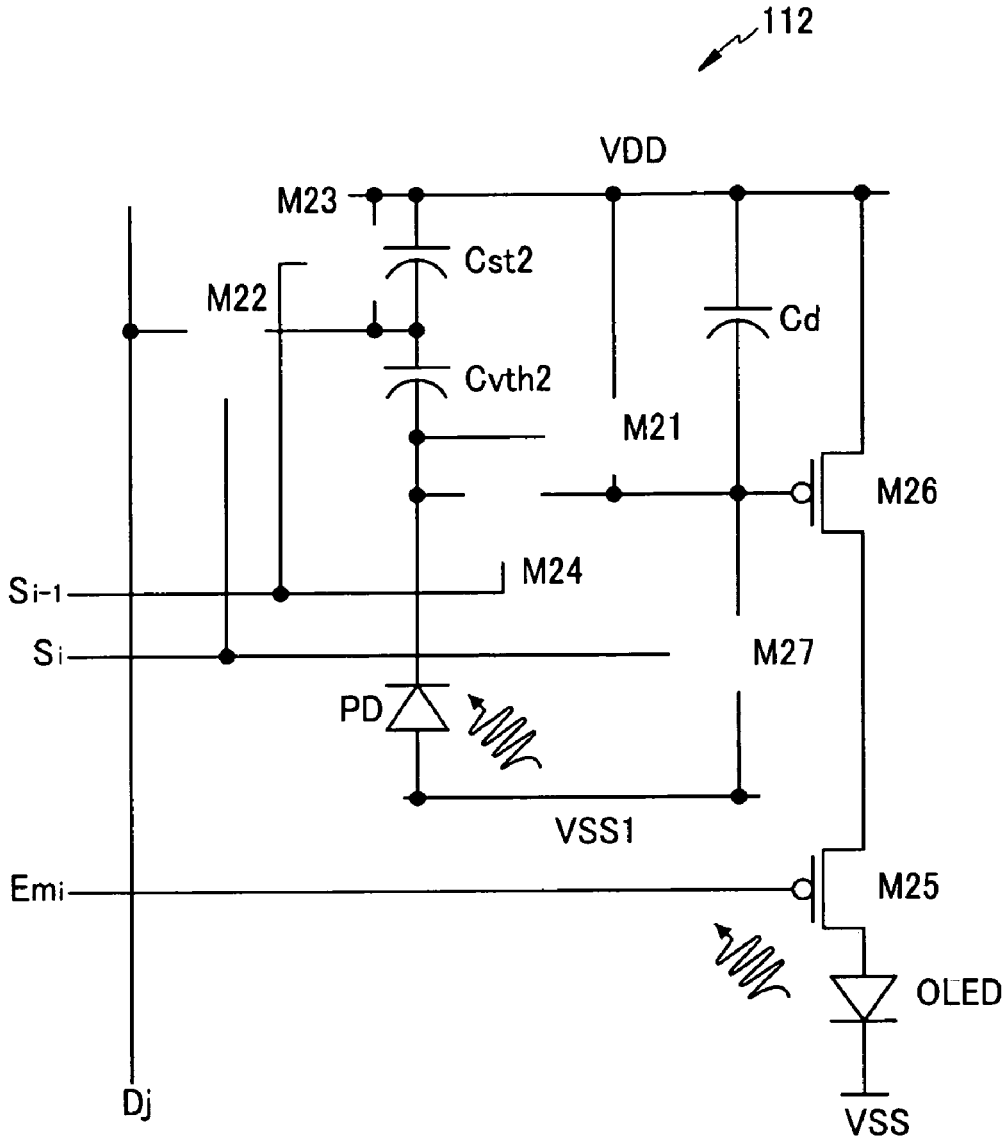

For a period T23, the current select signal select[i] is high-level, and the emission control signal emit[i] is low-level. Then, as shown in FIG. 6C, the transistor M25 is turned on such that a current $I_{OLED2}$ of the driving transistor M26 flows through the organic light emitting diode OLED. As a result, the organic light emitting diode OLED emits light. At this time, it is assumed that the voltage of $V_{DD}-V_{SS1}$ stored to the capacitor $C_d$ is a voltage that allows the transistor M26 to operate in a linear region.

Figure 6D:
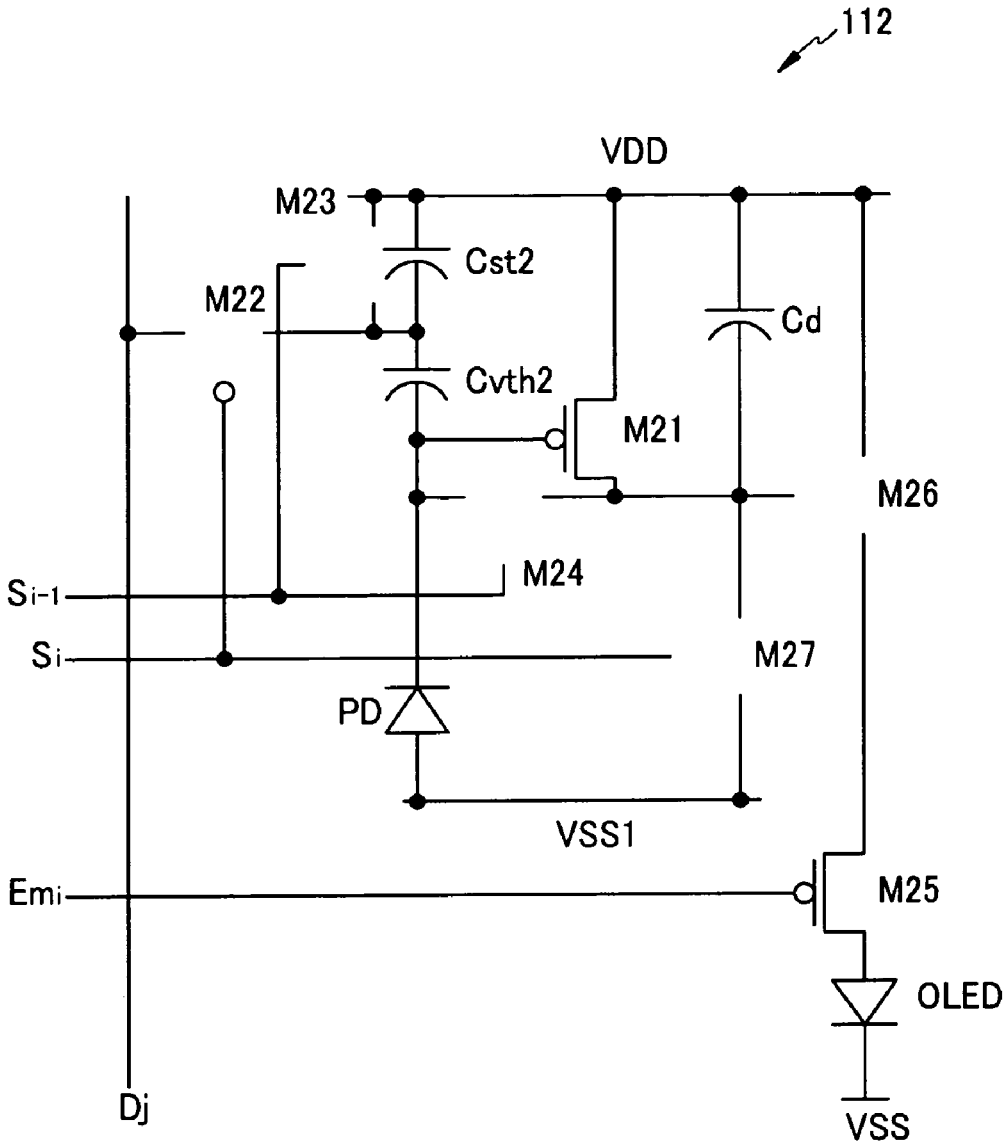

A current corresponding to the light emitted by the organic light emitting diode OLED flows to the photoelectric transformation element PD in the reverse direction such that the charges stored to the capacitors $C_{st2}$ and $C_{vth2}$ are changed. That is, the first electrode voltage of the capacitor $C_{vth2}$, i.e., the gate voltage of the transistor M21,is decreased by the current of the photoelectric transformation element PD. When the first electrode voltage of the capacitor $C_{vth2}$ is decreased to a voltage $V_{OFF}$ that causes the transistor M21 to be turned on, the transistor M21 is turned on as shown in FIG. 6D. As a result, the capacitor $C_d$ is discharged such that the transistor M26 is turned off. That is, the organic light emitting diode OLED does not emit light. At this time, since the voltage of $V_{TH2}+V_{data}-V_{DD}$ has been stored to the capacitors $C_{st2}$ and $C_{vth2}$, a period for which the first electrode voltage of the capacitor $C_{vth2}$ is decreased to the voltage $V_{OFF}$ is determined by the data voltage $V_{data}$. That is, the second exemplary embodiment controls an emitting period of the organic light emitting diode OLED with the data voltage $V_{data}$, thereby representing the gray level.

In addition, the voltage $V_{OFF}$ is determined by the threshold voltage of the transistor M21 since the transistor M21 is turned on when the gate-source voltage $V_{GS2}$ of the transistor M21 is greater than the threshold voltage $V_{TH2}$ of the transistor M21. Accordingly, the transistor M21 is turned on when the first electrode voltage of the capacitor $C_{vth2}$ is changed by a voltage of $V_{data}-V_{DD}$ due to the current of the photoelectric transformation element PD. That is, since a voltage variation of the capacitor $C_{vth2}$ until the transistor M21 is turned off is not affected by the threshold voltage $V_{TH2}$ of the transistor M21, the variation in the threshold voltage of the transistor M21 can be compensated.

Furthermore, when the brightness of the organic light emitting diode OLED is degraded as time passes, the magnitude of the current that is generated by the photoelectric transformation element PD is reduced. As a result, a time in which the first electrode voltage of the capacitor $C_{vth2}$ is reduced by the voltage for turning on the transistor M21 becomes longer such that the emission time of the organic light emitting diode OLED becomes longer. Accordingly, the pixel circuit 114 of FIG. 4 can compensate the degradation of the brightness of the organic light emitting diode OLED.

As described above, the pixel circuit 112 according to the second exemplary embodiment can compensate the variation of the threshold voltage of the control transistor M21 and the degradation of the brightness of the organic light emitting diode OLED. In addition, the driving transistor M26 can be operated in the linear region.

While the pixel circuits 111 and 112 have been shown to be formed by PMOS transistors in the first and second exemplary embodiments, the pixel circuits 111 and 112 may be formed by any other suitable transistors performing functions similar to the PMOS transistors, or a combination of any other suitable transistors and the PMOS transistors. An exemplary embodiment of a pixel circuit 112', which is similar to the pixel circuit 112 of FIG. 4 but is formed by NMOS (n-channel metal oxide semiconductor) transistor, will be described with reference to FIG. 7 and FIG. 8.

Figure 7:
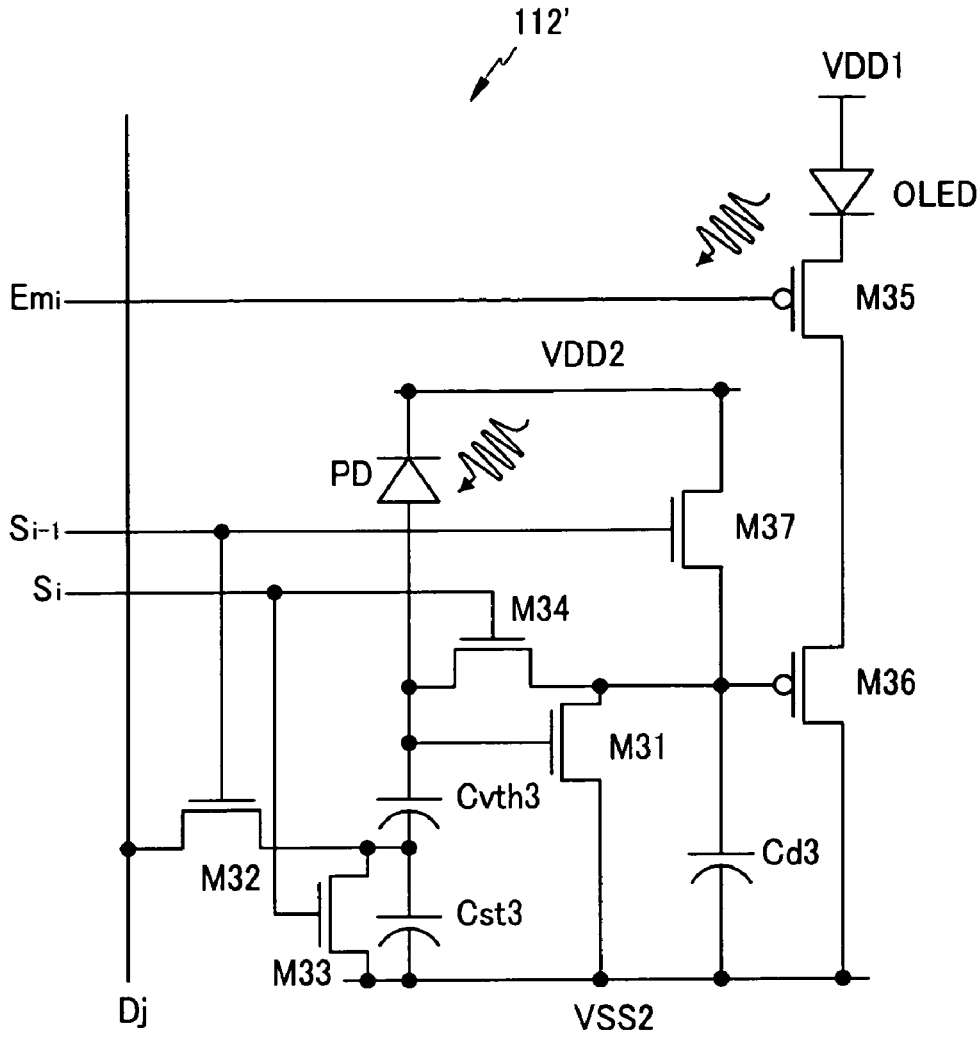
FIG. 7 shows a circuit diagram of a pixel circuit according to a third exemplary embodiment of the present invention.
Figure 8:
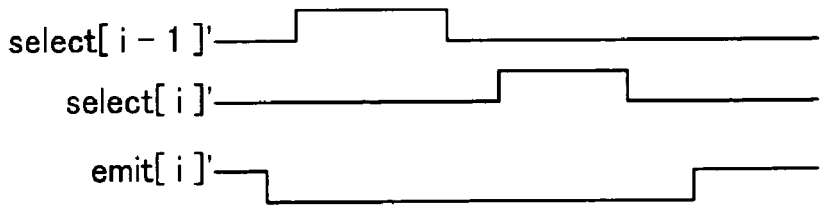
FIG. 8 shows a signal timing diagram of the pixel circuit shown in FIG. 7.

FIG. 7 shows a circuit diagram of a pixel circuit 112' according to a third exemplary embodiment of the present invention, and FIG. 8 shows a signal timing diagram of the pixel circuit 112' shown in FIG. 7.

As shown in FIG. 7, the pixel circuit 112' according to the third exemplary embodiment has NMOS transistors M31 to M37, and the connection of the transistors M31 to M37 is substantially symmetric to the connection of the transistors M21 to M27 shown in FIG. 4.

In more detail, sources of the transistors M31, M33, and M37 and first electrodes of capacitors $C_{st3}$ and $C_{d3}$ are coupled to a voltage source VSS2, and an anode of an organic light emitting diode OLED is coupled to a voltage source VDD1 supplying a voltage that is higher than the voltage source VSS2. A drain of the transistor M37 and a cathode of a photoelectric transformation element PD are coupled to a voltage source VDD2 supplying a voltage that is higher than the voltage source VSS2.

Referring to FIG. 8, each of previous and current select signals select[i−1]' and select and an emission control signal [i]' emit has a high-level voltage as an on voltage, and a low-level voltage as an off voltage. A data voltage $V_{data}$ has a voltage that is lower than the voltage $V_{SS2}$ supplied by the voltage source VSS2 and corresponds to a gray level, in order to maintain the transistor M31 at a turn-off state when the data voltage $V_{data}$ is programmed to the capacitors $V_{st3}$ and $V_{vth3}$.

As described above, the exemplary embodiments of the present invention can compensate for the variation of the threshold voltage of the transistor and the degradation of the brightness of the organic light emitting diode.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic light emitting diode display device comprising:

a first transistor having a first electrode coupled to a first voltage source;

a first capacitor coupled between a control electrode of the first transistor and the first voltage source;

a second transistor coupled between the control electrode of the first transistor and a second voltage source, and being adapted to turn on in response to an on voltage of a first control signal;

a third transistor having a first electrode coupled to the first voltage source and a second electrode coupled to the control electrode of the first transistor;

a fourth transistor having a first electrode coupled to a data line for transmitting a data voltage, and being adapted to transmit the data voltage in response to an on voltage of a second control signal;

a second capacitor for storing the data voltage from the fourth transistor, and for determining a voltage between the first electrode of the first transistor and the control electrode of the first transistor;

a threshold voltage compensator for compensating a threshold voltage of the third transistor together with the second capacitor;

an organic light emitting diode;

a fifth transistor for transmitting a current of a second electrode of the first transistor to the organic light emitting diode in response to an on voltage of a third control signal; and a photoelectric transformation element for transmitting a current corresponding to a light emitted by the organic light emitting diode to the second capacitor, wherein a first electrode of the second capacitor is coupled to the first voltage source, and the threshold voltage compensator comprises:

a sixth transistor for electrically coupling a control electrode of the third transistor to a second electrode of the third transistor in response to an on voltage of a fourth control signal;

a third capacitor having a first electrode coupled to the control electrode of the third transistor and a second electrode coupled to a second electrode of the second capacitor; and a seventh transistor coupling the first electrode of the third capacitor to the first voltage source in response to the on voltage of the fourth control signal.

2. The organic light emitting diode display device of claim 1, wherein the third control signal has an off voltage for a first period in which the threshold voltage compensator compensates the threshold voltage and for a second period in which the first control signal and the second control signal respectively have on voltages.

3. The organic light emitting diode display device of claim 1, wherein the photoelectric transformation element is coupled between the second voltage source and the second electrode of the third capacitor.

4. The organic light emitting diode display device of claim 1, wherein the fourth control signal has the on voltage before the first and second control signals have the on voltages.

5. The organic light emitting diode display device of claim 4, wherein the first and second control signals include a first select signal, and the fourth control signal includes a second select signal transmitted before the first select signal.

6. The organic light emitting diode display device of claim 4, wherein the third control signal has an off voltage for a period in which the first, second, and fourth control signals respectively have the on voltages.

7. The organic light emitting diode display device of claim 1, wherein a first electrode of the organic light emitting diode is coupled to a third voltage source, and the fifth transistor is coupled between the second electrode of the first transistor and a second electrode of the organic light emitting diode.

8. The organic light emitting diode display device of claim 7, wherein each of the first and third transistors includes a p-channel transistor, and the first voltage source supplies a higher voltage than the third voltage source.

9. The organic light emitting diode display device of claim 7, wherein each of the first and third transistors includes an n-channel transistor, and the first voltage source supplies a lower voltage than the third voltage source.

10. An organic light emitting diode display device comprising:

a first transistor having a first electrode coupled to a first voltage source;

a second transistor having a first electrode coupled to a data line for transmitting a data voltage, and being adapted to transmit the data voltage in response to an on voltage of a first control signal;

a first capacitor for storing the data voltage from the second transistor, and for determining a voltage between the first electrode of the first transistor and a control electrode of the first transistor;

a threshold voltage compensator for compensating a threshold voltage of the first transistor together with the first capacitor in response to an on voltage of a third control signal;

an organic light emitting diode;

a third transistor for transmitting a current of a second electrode of the first transistor to the organic light emitting diode in response to an on voltage of a second control signal; and a photoelectric transformation element coupled between the control electrode of the first transistor and the first voltage source, and for generating a current corresponding to a light emitted by the organic light emitting diode to the first capacitor, wherein the second control signal has an on voltage for a first portion of a first period in which the third control signal has the on voltage.

11. The organic light emitting diode display device of claim 10, wherein the second control signal has an off voltage for a second portion of the first period in which the third control signal has the on voltage and for a second period in which the first control signal has an on voltage.

12. The organic light emitting diode display device of claim 10 , wherein a first electrode of the first capacitor is coupled to the first voltage source, and the threshold voltage compensator comprises:

a fourth transistor for electrically coupling the control electrode of the first transistor to a second electrode of the first transistor in response to the on voltage of the third control signal;

a second capacitor having a first electrode coupled to the control electrode of the first transistor and a second electrode coupled to a second electrode of the first capacitor; and a fifth transistor coupling the first electrode of the second capacitor to the first voltage source in response to the on voltage of the third control signal.

13. The organic light emitting diode display device of claim 12, wherein the third control signal has the on voltage before the first control signal has the on voltage.

14. The organic light emitting diode display device of claim 13, wherein the first control signal includes a first select signal, and the third control signal includes a second select signal transmitted before the first select signal.

15. The organic light emitting diode display device of claim 12, wherein a first electrode of the organic light emitting diode is coupled to a second voltage source, and the third transistor is coupled between the second electrode of the first transistor and a second electrode of the organic light emitting diode.

16. The organic light emitting diode display device of claim 15, wherein the first transistor includes a p-channel transistor, and the first voltage source supplies a higher voltage than the second voltage source.

17. The organic light emitting diode display device of claim 15, wherein the first transistor includes an n-channel transistor, and the first voltage source supplies a lower voltage than the second voltage source.

* * * * *